US007044705B2

(12) United States Patent
Way

(10) Patent No.: US 7,044,705 B2
(45) Date of Patent: May 16, 2006

(54) LOAD HANDLING MACHINE

(75) Inventor: Richard Francis Way, Stafford (GB)

(73) Assignee: J.C. Bamford Excavators Limited, Staffordshire (GB)

( * ) Notice: Subject to any disclaimer, the term of this patent is extended or adjusted under 35 U.S.C. 154(b) by 0 days.

(21) Appl. No.: 10/879,944

(22) Filed: Jun. 29, 2004

(65) Prior Publication Data

US 2005/0036874 A1 Feb. 17, 2005

(30) Foreign Application Priority Data

Jul. 30, 2003 (GB) ..... 0317777.1

(51) Int. Cl.
*B66C 13/00* (2006.01)

(52) U.S. Cl. ..... 414/700; 60/563; 91/508

(58) Field of Classification Search ..... 414/680, 414/699, 700; 91/520, 508; 60/563, 484
See application file for complete search history.

(56) References Cited

U.S. PATENT DOCUMENTS

| | | | | |
|---|---|---|---|---|
| 3,836,025 | A | 9/1974 | Olson et al. | |
| 3,862,697 | A * | 1/1975 | Gill et al. | 414/700 |
| 4,266,909 | A * | 5/1981 | Langenfeld et al. | 414/700 |
| 4,822,237 | A | 4/1989 | Meyer et al. | |

FOREIGN PATENT DOCUMENTS

| | | |
|---|---|---|
| FR | 2600317 A1 | 6/1986 |
| FR | 2731729 A1 | 3/1995 |
| GB | 2013156 A | 8/1979 |
| GB | 2327076 A1 | 1/1999 |
| SU | 450779 | 11/1974 |

OTHER PUBLICATIONS

Search Report on the European Patent Office in application No. EP 04 01 4729, dated Sep. 13, 2005.

* cited by examiner

*Primary Examiner*—Donald W. Underwood
(74) *Attorney, Agent, or Firm*—Marshall, Gerstein & Borun LLP

(57) ABSTRACT

A load handling machine includes a body, a lifting arm pivotally mounted to the body about a first pivot axis, and a load handling implement pivotally mounted to the lifting arm about a second pivot axis. A first actuator provides movement about the first axis, and a second actuator provides movement about the second axis. A displacement device is mounted on the body and the lifting and includes a pair of cylinders. The second actuator and the displacement device are interconnected such that as the lifting arm is lowered, fluid ejected from one of the pair of cylinders of the displacement device is fed to an annulus side of the second actuator, and as the lifting arm is raised, fluid is ejected from annulus sides of both of the cylinders of the displacement device and is fed to a non-annulus side of the second actuator.

12 Claims, 3 Drawing Sheets

LOAD HANDLING MACHINE

BACKGROUND TO THE INVENTION

This invention relates to a load handling machine and more particularly to a load handling machine which includes a body, a lifting arm pivotally mounted at or adjacent one end to the body for pivotal movement about a first generally horizontal pivot axis, and the lifting arm carrying at a second end opposite to the first end, a load handling implement, which is mounted for pivotal movement relative to the lifting arm about a second generally horizontal pivot axis.

DESCRIPTION OF THE PRIOR ART

In such a machine, typically to raise and permit of controlled lowering of the lifting arm about the first pivot axis, a first fluid operated linear actuator is provided which is pivotally mounted at respective first and second ends to the body of the machine at one side of the first pivot axis, and to the lifting arm. A second fluid operated linear actuator is provided, typically mounted within the lifting arm, or at least above the second pivot axis, which acts to pivot the load handling implement about the second pivot axis relative to the lifting arm, through a lever, for maximum mechanical advantage.

In one typical arrangement, there is a linear displacement device which includes a piston moveable in a cylinder, which is pivotally mounted at respective first and second ends to the body of the machine at the opposite side of the first pivot axis as the first actuator, and to the lifting arm, so that as the lifting arm is raised, fluid is ejected from one side of the piston of the displacement device and is fed to the second actuator which extends, to pivot the load handling implement as the arm is raised, such that the attitude of the load handling implement relative to the ground is maintained. Conversely, as the lifting arm is lowered fluid is ejected from the other side of the piston of the displacement device and is fed to the second actuator, so that as the lifting arm lowers, the attitude of the load handling implement relative to the ground, is maintained.

The second actuator typically is a piston and cylinder type actuator, and a fluid circuit is arranged so that for example, fluid is ejected from a non-annulus side of the displacement device as the arm is raised, and is fed to a non-annulus side of the second actuator as the arm is raised, and conversely, fluid is ejected from the annulus side of the displacement device as the arm is lowered, and is fed to the annulus side of the second actuator. Thus by matching the sizes of the displacement device and the second actuator, and/or arranging their respective distances from their respective pivots so that the changes in the volumes of fluid in the displacement device and second actuator are substantially the same, a load may be reliably and mechanically maintained at a generally level attitude for example, during raising and lowering of the lifting arm, without operator intervention.

A disadvantage with such a machine is that the lifting arm must extend beyond the first pivot axis, to provide a pivotal mounting for the displacement device. Moreover, particularly during raising of the lifting arm, fluid which is displaced from the displacement device, will provide a resistance to raising of the arm, which is inefficient.

It has been proposed to mount the displacement device at the same one side of the first pivot axis as the first actuator. Thus no lifting arm extension beyond the first pivot axis is required. However, the displacement device will act oppositely to that described where the displacement device is at the opposite side of the first pivot axis to the first lifting actuator. That is, as the lifting arm is raised, fluid will be ejected from an annulus side of the displacement device, and as the lifting arm is lowered, fluid will be ejected from the non-annulus side of the displacement device. Fluid displaced from the annulus side of the displacement device during arm raising and from the non-annulus side of the displacement device during arm lowering cannot readily be arranged to be fed to the respective non-annulus and annulus sides of the second actuator to maintain the attitude of the load handling implement during both lifting and lowering.

Accordingly, in a machine where the displacement device is mounted to the body at the same side that the first actuator is mounted to the body, the second actuator tends to be mounted beneath the lifting arm so as to act between the lifting arm below the second pivot, to pivot the load handling implement. This is disadvantageous in that with such an arrangement, less mechanical advantage can be realised when it is desired to pivot the loading implement about the second pivot axis, for example where the load handling implement is a bucket, and it is desired to pivot the bucket relative to the lifting arm, for example to dig into material to be dug.

SUMMARY OF THE INVENTION

According to a first aspect of the invention we provide a load handling machine including a body, a lifting arm pivotally mounted at or closely adjacent one end to the body for pivotal movement about a first generally horizontal pivot axis, and the lifting arm carrying at a second end opposite to the first end, a load handling implement, which is mounted for pivotal movement relative to the lifting arm about a second generally horizontal pivot axis, a first fluid operated linear actuator pivotally mounted at respective first and second ends to the body of the machine at one side of the first pivot axis, and to the lifting arm, for raising and permitting of lowering the lifting arm about the first pivot axis, and a second fluid operated linear actuator for pivoting the load handling implement about the second pivot axis, the second actuator including a piston linearly moveable in a cylinder, the cylinder thus having an annulus side and a non-annulus side, and there being a linear displacement device which includes a pair of cylinders each having linearly moveable therein, a respective piston, each cylinder thus having an annulus side and a non-annulus side, and each cylinder being pivotally mounted at respective first and second ends to the body of the machine at the same one side of the first pivot axis as the first actuator, and to the lifting arm, and wherein the second actuator is mounted above the second pivot axis and is operable to pivot the load handling implement through a lever, the second actuator and the displacement device being interconnected so that as the lifting arm is lowered, fluid is ejected from a non-annulus side of one of the pair of cylinders of the displacement device and is fed to an annulus side of the second actuator, and as the lifting arm is raised, fluid is ejected from the annulus sides of both of the cylinders of the displacement device and is fed to the non-annulus side of the cylinder of the second actuator thus to maintain the attitude of the load handling implement relative to the ground, during lowering and raising of the lifting arm.

A machine in accordance with the invention, may realise the advantage of a machine in which the displacement device is mounted on the body of the machine on the same side of the first pivot axis as the first lifting actuator, i.e. the length of the machine can be reduced as there is no requirement for a lifting arm extension beyond the lifting axis, whilst retaining the advantage of having the second actuator being provided above the second pivot axis, e.g. within the lifting arm, and acting to pivot the load handling implement, through a lever which provides maximum mechanical advantage.

To realise the invention, preferably the volume of fluid ejected from the non-annulus side of the cylinder of the second actuator during lowering of the lifting arm is substantially the same as the combined changes in volumes of the annulus sides of the cylinders of the displacement device, and the volume of fluid ejected from annulus side of the cylinder of the second actuator during raising of the lifting arm, is substantially the same as the changing volume of the non-annulus side of the one cylinder of the displacement device.

Desirably, during raising of the lifting arm, fluid pressure which is fed to the first actuator is transmitted to a the non-annulus side of at least one of the cylinders of the displacement device, which thus acts to assist the first actuator in raising the lifting arm. For example, fluid from a fluid line to the first actuator may be fed to the non-annulus side of the other of the pair of cylinders of the displacement device, and if desired, a fluid line between the annulus side of the second actuator and the non-annulus side of the one of the pair of cylinders of the displacement device, may pressurised by fluid pressure from the fluid line to the first actuator, e.g. through a check valve, so that the one cylinder of the displacement device too may be pressurised and may assist raising of the arm.

During lowering of the lifting arm, pressure in the fluid line to the first actuator may be relieved, so that fluid may pass from the non-annulus side of the other of the pair of cylinders of the displacement device, to low pressure.

The fluid line for pressurised fluid to the first actuator to raise the lifting arm, and the fluid line between the annulus side of the second actuator and the non-annulus side of the one cylinder of the displacement device, may each include a counterbalance valve, so that that in the event of a loss in pressure, e.g. due to the failure of a fluid line between on the one hand, the respective counterbalance valve and the first actuator, and on the other hand, the respective counterbalance valve and the second actuator, the geometry of the respective actuator will be retained. Thus the risk of a load being suddenly lowered or discharged from the working implement, will be reduced.

According to a second aspect of the invention we provide a method of lowering a load carried on a lifting arm of a load handling machine of the kind in which the lifting arm pivotally mounted at or closely adjacent one end to a body of the machine for pivotal movement about a first generally horizontal pivot axis, and the lifting arm carrying at a second end opposite to the first end, a load handling implement, which is mounted for pivotal movement relative to the lifting arm about a second generally horizontal pivot axis, a first fluid operated linear actuator pivotally mounted at respective first and second ends to the body of the machine at one side of the first pivot axis, and to the lifting arm, for raising and permitting of lowering the lifting arm about the first pivot axis, and a second fluid operated linear actuator for pivoting the load handling implement about the second pivot axis, the second actuator including a piston linearly moveable in a cylinder, the cylinder thus having an annulus side and a non-annulus side, and there being a linear displacement device which includes a pair of cylinders each having linearly moveable therein, a respective piston, each cylinder thus having an annulus side and a non-annulus side, and each cylinder being pivotally mounted at respective first and second ends to the body of the machine at the same one side of the first pivot axis as the first actuator, and to the lifting arm, and wherein the second actuator is mounted above the second pivot axis and is operable to pivot the load handling implement through a lever, the method including during lowering of the lifting arm, feeding fluid ejected from a non-annulus side of one of the pair of cylinders of the displacement device to an annulus side of the second actuator, thus to maintain the attitude of the load handling implement relative to the ground, during lowering of the lifting arm.

According to a third aspect of the invention we provide a method of raising a load carried on a lifting arm of a load handling machine of the kind in which the lifting arm pivotally mounted at or closely adjacent one end to a body of the machine for pivotal movement about a first generally horizontal pivot axis, and the lifting arm carrying at a second end opposite to the first end, a load handling implement, which is mounted for pivotal movement relative to the lifting arm about a second generally horizontal pivot axis, a first fluid operated linear actuator pivotally mounted at respective first and second ends to the body of the machine at one side of the first pivot axis, and to the lifting arm, for raising and permitting of lowering the lifting arm about the first pivot axis, and a second fluid operated linear actuator for pivoting the load handling implement about the second pivot axis, the second actuator including a piston linearly moveable in a cylinder, the cylinder thus having an annulus side and a non-annulus side, and there being a linear displacement device which includes a pair of cylinders each having linearly moveable therein, a respective piston, each cylinder thus having an annulus side and a non-annulus side, and each cylinder being pivotally mounted at respective first and second ends to the body of the machine at the same one side of the first pivot axis as the first actuator, and to the lifting arm, and wherein the second actuator is mounted above the second pivot axis and is operable to pivot the load handling implement through a lever, the method including during raising of the lifting arm, feeding fluid ejected from the annulus sides of both of the cylinders of the displacement device to the non-annulus side of the cylinder of the second actuator thus to maintain the attitude of the load handling implement relative to the ground, during raising of the lifting arm.

BRIEF DESCRIPTION OF THE DRAWINGS

Embodiments of the invention will now be described with reference to the accompanying drawings in which.

DESCRIPTION OF THE PREFERRED EMBODIMENTS

Figure 1:
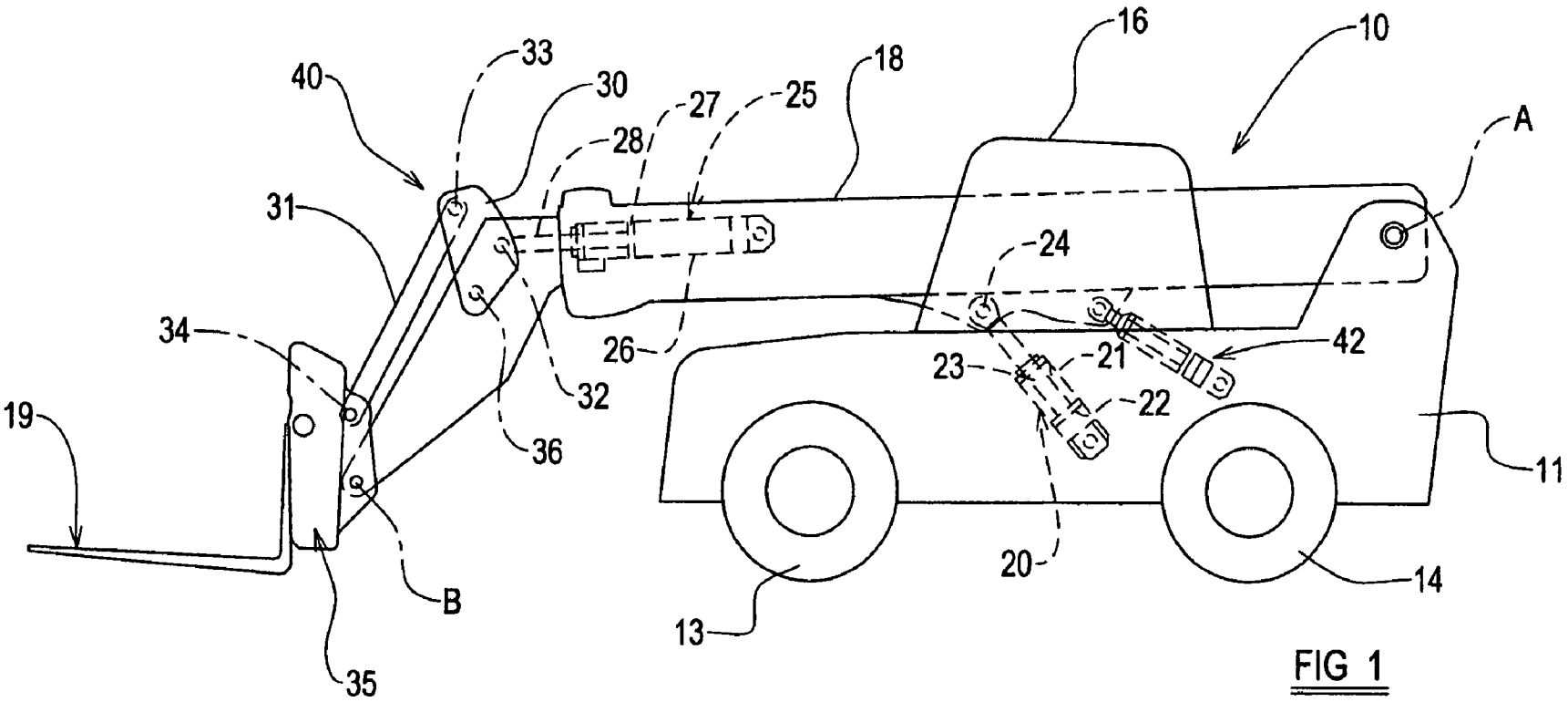
FIG. 1 is an illustrative side view of a load handling machine in accordance with the invention.
Figure 2:
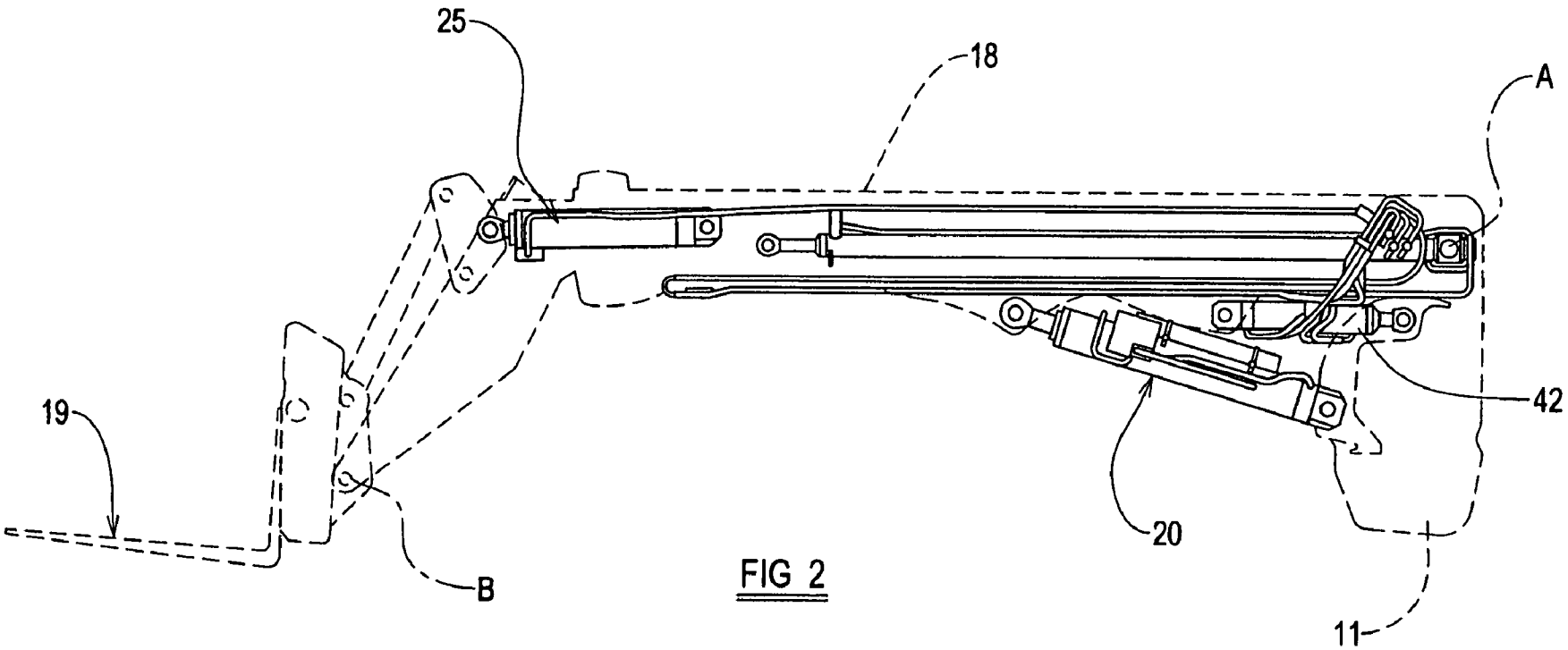
FIG. 2 is a more detailed side cross sectional view of part of the lifting arm of the machine of FIG. 1.

Referring to the drawings, a load handling machine 10 includes a body 11 mounted on a ground engaging structure which in this example includes a front pair of wheels 13 and a rear pair of wheels 14 whereby the machine 10 is moveable over the ground. The machine 10 includes an operator's cab 16 from which the machine 10 is controllable, and a lifting arm 18 for raising and lowering of a load on a load handling implement 19.

The lifting arm 18 is mounted on the body 11 for up and down pivotal movement about a first generally horizontal axis A which in this example is positioned to the rear of the cab 16, but in another example may be in front of the cab 16.

A first fluid operated linear actuator 20 is provided to raise and permit of lowering of the lifting arm 18, the actuator including a cylinder 21 pivotally mounted on the body 11, and a piston 22 linearly moveable in the cylinder 21, the piston 22 being fast with a piston rod 23 which is pivotally connected to a mounting 24 beneath the lifting arm 18, in front of the pivot axis A, so that as the first actuator 20 is extended, the lifting arm 18 is raised about the axis A, and as the first actuator is retracted, the lifting arm 18 may lower.

In this example, the load handling implement 19 is a pair of lifting forks on a carriage 35, but these could be replaced by a bucket or any other desired load handling implement.

The load handling implement 19 is pivotally mounted for pivotal movement about a second generally horizontal axis B, to the lifting arm 18, at an end of the lifting arm 18 remote from the first generally horizontal axis A. The lifting arm 18 may include a plurality of telescopic sections so that the load may be moved away from and towards the body 11 of the machine 10, in which case, the load handling implement would be provided on the outermost section.

Pivoting of the load handling implement 19 about the second generally horizontal axis B is achieved by a second fluid operated linear actuator 25 which includes a cylinder 26, a piston 27 linearly moveable in the cylinder 26, and a piston rod 28 fast with the piston 27. The cylinder 26 is pivotally mounted inside the lifting arm 18, above the second generally horizontal axis B, and acts to pivot the load handling implement about the second generally horizontal axis B through a lever provided by a linkage mechanism 40.

The piston rod 28 is pivotally mounted at 32 to a first link 30 of the mechanism 40, which first link 30 acts as a lever which is pivotally mounted to both a second link 31, at 33, and to the lifting arm 18, as indicated at 36 in the drawing, whereby maximum mechanical advantage can be achieved through the mechanism 40 as the second actuator 25 is extended and retracted. Although other linkage arrangements are possible, in this example, the second link 31 extends between the first link 30 and a pivotal mounting 34 on a carriage 35 which carries the forks of the load handling implement 19.

In another example, the piston 27 of the second actuator 25 could be directly coupled to the carriage 35, above the second pivot axis B, where the particular geometry allows this.

Such a linkage mechanism 40 is well known and further detailed description is not considered necessary.

The linkage mechanism 40 is particularly effective where the load handling implement 19 is a bucket which may be required to dig into a pile of earth or the like, as the maximum mechanical advantage can be realised with the digging bucket at an appropriate angular position about the second generally horizontal axis B, for digging, which is typically where a lower surface of the bucket is generally level with the (level) ground.

In accordance with the invention, provided beneath the lifting arm 18, there is a displacement device 42 which includes a pair of cylinders 44*a*, 44*b*, each with respective pistons 45*a*, 45*b* linearly moveably mounted inside, each piston 45*a*, 45*b* being fast with a respective piston rod 46*a*, 46*b*. The cylinders 44*a*, 44*b* are each pivotally mounted to the body 11 of the machine 10, whilst the piston rods 46*a*, 46*b* are each pivotally mounted to the lifting arm 18 at respective pivotal connections 48 at the same side of the first generally horizontal axis A as the first lifting actuator 20.

As the lifting arm 18 is raised, the pistons 45*a*, 45*b* in each of the cylinders 44*a*, 44*b* of the displacement device 42 will move linearly to extend the length of the displacement device 42, and conversely when the lifting arm 18 is permitted to lower, the length of the displacement device 42 will retract.

Figure 3:
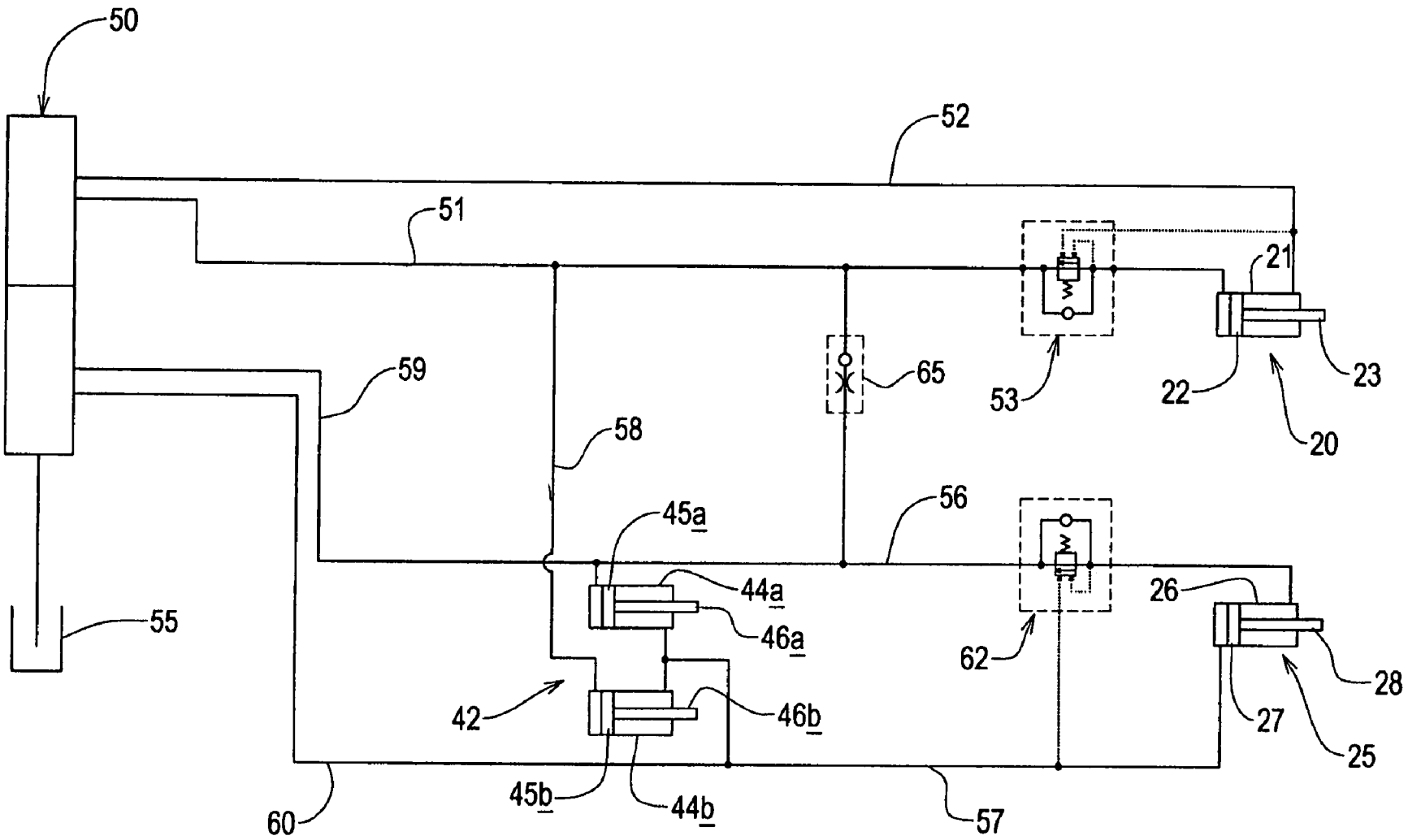
FIG. 3 is an illustrative hydraulic circuit diagram of the machine of FIG. 1.

Referring now particularly to FIG. 3, a fluid flow control valve 50 is provided by means of which pressurised fluid from a pump may be controlled to be directed along a (lower as shown in the drawing) fluid line 51 to a non-annulus side of the cylinder 21 of the first actuator 20, to extend the actuator 20, thus to raise the lifting arm 18 and at the same time to permit fluid ejected from an annulus side of the cylinder 21 of the first actuator 20 to flow to a low pressure region along a, (upper as shown in the drawing) return, fluid line 52, or alternatively to control pressurised fluid to be directed along the upper line 52 to the annulus side of the cylinder 21 of the first actuator 20 to permit the lifting arm 18 to lower and at the same time to allow fluid ejected from the non-annulus side of the cylinder 21 of the first actuator 20 to pass along the lower fluid line 51 to a low pressure region, e.g. tank 55.

In the lower fluid line 51 along which the pressurised fluid passes to the non-annulus side of the cylinder 21 of the first actuator 20 to raise the lifting arm 18, there is provided a counterbalance valve 53, to prevent the sudden lowering of the lifting arm 18 in the event of the failure of either of the fluid lines 51, 52, as is known in the art.

A (upper as seen in the drawing) fluid line 56 is provided between the annulus side of the piston 27 of the second fluid operated linear actuator 25 and the non-annulus side of the one cylinder 44*a* (the upper as seen in the drawing) of the pair of cylinders 44*a*, 44*b* of the displacement device 42, and a further (lower as seen in the drawing) fluid line 57 is provided between the non-annulus side of the cylinder 26 of the second actuator 25 and both of the annulus sides of the cylinders 44*a*, 44*b* of the displacement device 42.

Another fluid line 58 extends between the non-annulus side of the other cylinder 44*b* of the pair of cylinders 44*a*, 44*b* of the displacement device 42 and the lower fluid line 51 between the control valve 50 and the non-annulus side of the cylinder 21 of the first actuator 20.

Respective fluid lines 59, 60 extend between the upper fluid line 56 to the annulus side of the cylinder 26 of the second actuator 25, and the flow control valve 50, and between the lower fluid line 57 to the non-annulus side of the cylinder 26 of the second actuator 20 and the flow control valve 50, so that the second actuator 25 may when required, be operated to tilt the loading implement 19 about the second generally horizontal axis B under operator control.

In the upper fluid line 56, between the displacement device 42 and the annulus side of the cylinder 26 of the second actuator 25, there is a second counterbalance valve 62 for protecting against the sudden discharge of a load being carried, in the event of a failure of either of the fluid lines 59/56 or 60/57.

The fluid system operated as follows.

During raising of the lifting arm 18, by extending the first actuator 20, the fluid lines 59, 60 from the flow control valve 50 to the second actuator 25 may be closed by the flow control valve 50. As the arm 18 is raised, the piston rods 46*a*, 46*b* of the displacement device 42 will be moved outwardly from their respective cylinders 44*a*, 44*b* to extend the displacement device 42. Fluid at the arm lift pressure in the lower fluid line 51 to the first actuator 20 will be communicated to the non-annulus side of the piston 45*b* of the lower cylinder 44*b* of the displacement device 42 to assist raising of the arm 18, and fluid pressure from the lower fluid line 51 to the first actuator 20 will also be communicated, via a check valve 65 to the upper fluid line 56 to the second actuator 25, and hence to the non-annulus side of the upper cylinder 44*a*, of the displacement device 42 to assist raising of the lifting arm 18.

Fluid which is ejected from the annulus side of the cylinder 26 of the second actuator 25 will be communicated to the non-annulus side of the piston 45*a* of the one only (upper) of the cylinders 44*a* of the displacement device 42, via the second counterbalance valve 62.

At the same time, fluid will be ejected from each of the annulus sides of the cylinders 44*a*, 44*b* of the displacement device 42 and will pass along the lower fluid line 57 to the non-annulus side of the second actuator 25 thus causing piston 27 of the second actuator 25 to move in its cylinder 26. The volume of fluid ejected from the cylinders 44*a*, 44*b* of the displacement device 42 is substantially equal to the changing volume of the non-annulus side of the cylinder 26 of the second actuator, so that the load handling implement 19 is caused to pivot about the second generally pivotal axis B by an amount proportional to the changing angle of the lifting arm 18 about the first generally horizontal axis A, so the attitude of the load handling implement 19 relative to the ground, is maintained during arm 18 lifting.

During lowering of the lifting arm 18, by retracting the first actuator 20, and with the fluid lines 59, 60 from the flow control valve 50 to the second actuator 25 still closed by the flow control valve 50, the piston rods 46*a*, 46*b* of the displacement device 42 will be moved inwardly from their respective cylinders 44*a*, 44*b* to retract the displacement device 42. Pressurised fluid from the flow control valve 50 will be communicated to the annulus side of the piston 22 of the first actuator 20, and fluid ejected from the non-annulus side of the cylinder 21 of the first actuator 20, will pass along the fluid line 51 to the low pressure region 55.

At the same time fluid ejected from the non-annulus side of cylinder 26 of the second actuator 25 will pass along the lower fluid line 57 to each of the annulus sides of the cylinders 44*a*, 44*b* of the displacement device 42 thus causing the pistons 45*a*, 45*b* of the displacement device 42, to move in their cylinders.

The volume of fluid ejected from the non-annulus side of the cylinder 26 of the second actuator 25 is again substantially equal to the changing volumes of annulus sides of the cylinder 44*a*, 44*b* of the displacement device 42. Thus the load handling implement 19 is caused to pivot about the second generally pivotal axis B by an amount proportional to the changing angle of the lifting arm 18 about the first generally horizontal axis A, but oppositely to the pivot direction during lifting arm 18 raising, so the attitude of the load handling implement 19 relative to the ground, is maintained during arm 18 lowering.

Fluid ejected from the non-annulus side of the lower cylinder 44*b* of the displacement device 42 passes along the fluid line 58 to the lower fluid line 51 to the first actuator 20, and hence to the low pressure region 55.

Various modifications may be made without departing from the scope of the invention. For example, the location and type of counterbalance valves 53, 62 may be changed depending upon the detailed nature of the hydraulic circuit, and instead of or in addition to the check valve 65 in the line 56 from the lower fluid line to the first actuator 20 and the upper fluid line to the second actuator, another valve to maintain pressure in the fluid line 56 to the second actuator 25 may be provided.

The flow control valve 50 is preferably a spool valve having separate spools for separately controlling the flow of fluid to the first actuator 20 and the second actuator 25, although other flow control valve arrangements, e.g. separate flow control valves for each actuator 20, 25 may be provided.

In accordance with the invention, by closing the flow control fluid lines 59, 60 between the flow control valve 50 and the second actuator 25, the lifting arm 18 may be raised and lowered whilst the attitude of the load is maintained without operator intervention, and by providing a pair of displacement cylinder 44*a*, 44*b* in a circuit as described, these may be positioned at the same side of the first generally horizontal axis A as the first actuator 20, whilst the second actuator 25 may be positioned above the second generally horizontal pivot axis B, within the lifting arm 18 as shown or elsewhere, and my thus act to pivot the load handling implement 19 about the second generally horizontal axis B through the lever provided by the linkage mechanism 40, whilst achieving the best mechanical advantage.

The invention claimed is:

1. A load handling machine including a body, a lifting arm pivotally mounted at or closely adjacent one end to the body for pivotal movement about a first generally horizontal pivot axis, and the lifting arm carrying at a second end opposite to the first end, a load handling implement, which is mounted for pivotal movement relative to the lifting arm about a second generally horizontal pivot axis, a first fluid operated linear actuator pivotally mounted at respective first and second ends to the body of the machine at one side of the first pivot axis, and to the lifting arm, for raising and effecting lowering of the lifting arm about the first pivot axis, and a second fluid operated linear actuator for pivoting the load handling implement about the second pivot axis, the second actuator including a piston linearly moveable in a cylinder, the cylinder thus having an annulus side and a non-annulus side, and there being a linear displacement device which includes a pair of cylinders each having linearly moveable therein, a respective piston, each cylinder thus having an annulus side and a non-annulus side, and each cylinder being pivotally mounted at respective first and second ends to the body of the machine at the same one side of the first pivot axis as the first actuator, and to the lifting arm, and wherein the second actuator is mounted above the second pivot axis and is operable to pivot the load handling implement through a lever, the second actuator and the displacement device being interconnected so that as the lifting arm is lowered, fluid is ejected from a non-annulus side of one of the pair of cylinders of the displacement device and is fed to an annulus side of the second actuator, and as the lifting arm is raised, fluid is ejected from the annulus sides of both of the cylinders of the displacement device and is fed to the non-annulus side of the cylinder of the second actuator thus to maintain the attitude of the load handling implement relative to the ground, during lowering and raising of the lifting arm.

2. A machine according to claim 1 wherein the second actuator is pivotally mounted within the lifting arm, and acts to pivot the load handling implement, through a lever.

3. A machine according to claim 1 wherein the volume of fluid ejected from the non-annulus side of the cylinder of the second actuator during lowering of the lifting arm is substantially the same as the combined changes in volumes of the annulus sides of the cylinders of the displacement device, and the volume of fluid ejected from annulus side of the cylinder of the second actuator during raising of the lifting arm, is substantially the same as the changing volume of the non-annulus side of the one cylinder of the displacement device.

4. A machine according to claim 1 wherein during raising of the lifting arm, fluid pressure which is fed to the first actuator is transmitted to a the non-annulus side of at least one of the cylinders of the displacement device, which thus acts to assist the first actuator in raising the lifting arm.

5. A machine according to claim 4 wherein during raising of the lifting arm, fluid from a fluid line to the first actuator is fed to the non-annulus side of the other of the pair of cylinders of the displacement device.

6. A machine according to claim 4 wherein a fluid line between the annulus side of the second actuator and the non-annulus side of the one of the pair of cylinders of the displacement device, is pressurised by fluid pressure from the fluid line to the first actuator so that the one cylinder of the displacement device too may assist raising of the arm.

7. A machine according to claim 6 wherein the fluid line between the annulus side of the second actuator and the non-annulus side of the one of the pair of cylinders of the displacement device, is pressurised through a check valve.

8. A machine according to claim 5 wherein during lowering of the lifting arm, pressure in the fluid line to the first actuator is relieved, so that fluid may pass from the non-annulus side of the other of the pair of cylinders of the displacement device, to low pressure.

9. A machine according to claim 1 wherein the fluid line for pressurised fluid to the first actuator to raise the lifting arm includes a counterbalance valve.

10. A machine according to claim 1 wherein the fluid line between the annulus side of the second actuator and the non-annulus side of the one cylinder of the displacement device, includes a counterbalance valve.

11. A method of lowering a load carried on a lifting arm of a load handling machine of the kind in which the lifting arm pivotally mounted at or closely adjacent one end to a body of the machine for pivotal movement about a first generally horizontal pivot axis, and the lifting arm carrying at a second end opposite to the first end, a load handling implement, which is mounted for pivotal movement relative to the lifting arm about a second generally horizontal pivot axis, a first fluid operated linear actuator pivotally mounted at respective first and second ends to the body of the machine at one side of the first pivot axis, and to the lifting arm, for raising and effecting lowering of the lifting arm about the first pivot axis, and a second fluid operated linear actuator for pivoting the load handling implement about the second pivot axis, the second actuator including a piston linearly moveable in a cylinder, the cylinder thus having an annulus side and a non-annulus side, and there being a linear displacement device which includes a pair of cylinders each having linearly moveable therein, a respective piston, each cylinder thus having an annulus side and a non-annulus side, and each cylinder being pivotally mounted at respective first and second ends to the body of the machine at the same one side of the first pivot axis as the first actuator, and to the lifting arm, and wherein the second actuator is mounted above the second pivot axis and is operable to pivot the load handling implement through a lever, the method including during lowering of the lifting arm, feeding fluid ejected from a non-annulus side of one of the pair of cylinders of the displacement device to an annulus side of the second actuator, thus to maintain the attitude of the load handling implement relative to the ground, during lowering of the lifting arm.

12. A method of raising a load carried on a lifting arm of a load handling machine of the kind in which the lifting arm pivotally mounted at or closely adjacent one end to a body of the machine for pivotal movement about a first generally horizontal pivot axis, and the lifting arm carrying at a second end opposite to the first end, a load handling implement, which is mounted for pivotal movement relative to the lifting arm about a second generally horizontal pivot axis, a first fluid operated linear actuator pivotally mounted at respective first and second ends to the body of the machine at one side of the first pivot axis, and to the lifting arm, for raising and effecting lowering of the lifting arm about the first pivot axis, and a second fluid operated linear actuator for pivoting the load handling implement about the second pivot axis, the second actuator including a piston linearly moveable in a cylinder, the cylinder thus having an annulus side and a non-annulus side, and there being a linear displacement device which includes a pair of cylinders each having linearly moveable therein, a respective piston, each cylinder thus having an annulus side and a non-annulus side, and each cylinder being pivotally mounted at respective first and second ends to the body of the machine at the same one side of the first pivot axis as the first actuator, and to the lifting arm, and wherein the second actuator is mounted above the second pivot axis and is operable to pivot the load handling implement through a lever, the method including during raising of the lifting arm, feeding fluid ejected from the annulus sides of both of the cylinders of the displacement device to the non-annulus side of the cylinder of the second actuator thus to maintain the attitude of the load handling implement relative to the ground, during raising of the lifting arm.

* * * * *

UNITED STATES PATENT AND TRADEMARK OFFICE

CERTIFICATE OF CORRECTION

PATENT NO. : 7,044,705 B2
APPLICATION NO. : 10/879944
DATED : May 16, 2006
INVENTOR(S) : Richard F. Way It is certified that error appears in the above-identified patent and that said Letters Patent is hereby corrected as shown below:

In the Claims

At Column 9, line 8, "to a the" should be --to the--.

Signed and Sealed this

Twenty-fifth Day of August, 2009

David J. Kappos

David J. Kappos
*Director of the United States Patent and Trademark Office*